US009045959B1

(12) United States Patent
Lugo

(10) Patent No.: US 9,045,959 B1
(45) Date of Patent: Jun. 2, 2015

(54) INSERT TUBE FOR USE WITH A LOWER MARINE RISER PACKAGE

(71) Applicant: Mario R. Lugo, Houston, TX (US)

(72) Inventor: Mario R. Lugo, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 315 days.

(21) Appl. No.: 13/623,986

(22) Filed: Sep. 21, 2012

(51) Int. Cl.
*E21B 7/12* (2006.01)
*E21B 33/035* (2006.01)

(52) U.S. Cl.
CPC ..... *E21B 33/035* (2013.01)

(58) Field of Classification Search
CPC ..... E21B 17/01; E21B 17/085; E21B 33/035; E21B 33/038
USPC ..... 166/360, 367, 368
See application file for complete search history.

(56) References Cited

U.S. PATENT DOCUMENTS

| | | | | | |
|---|---|---|---|---|---|
| 4,324,505 | A | | 4/1982 | Hammett | |
| 4,405,258 | A | | 9/1983 | O'Rourke et al. | |
| 4,444,250 | A | | 4/1984 | Keithahn et al. | |
| 4,502,534 | A | | 3/1985 | Roche et al. | |
| 4,554,973 | A | * | 11/1985 | Shonrock et al. | 166/192 |
| 4,646,844 | A | | 3/1987 | Roche et al. | |
| 4,727,939 | A | * | 3/1988 | Airey | 166/332.8 |
| 4,828,024 | A | | 5/1989 | Roche | |
| 5,205,358 | A | * | 4/1993 | Mitzlaff | 166/187 |
| 5,323,860 | A | | 6/1994 | Watkins | |
| 5,984,012 | A | | 11/1999 | Wactor et al. | |
| 6,230,824 | B1 | | 5/2001 | Peterman et al. | |
| 7,165,619 | B2 | | 1/2007 | Fox et al. | |
| 7,308,954 | B2 | | 12/2007 | Martin-Marshall | |
| 7,597,811 | B2 | | 10/2009 | Usher | |
| 7,921,917 | B2 | * | 4/2011 | Kotrla et al. | 166/339 |
| 8,322,429 | B2 | * | 12/2012 | Judge et al. | 166/341 |
| 8,365,830 | B2 | * | 2/2013 | Kotrla et al. | 166/338 |
| 8,393,399 | B2 | * | 3/2013 | Judge | 166/366 |
| 8,555,976 | B2 | * | 10/2013 | Ebenezer | 166/340 |
| 2004/0154805 | A1 | * | 8/2004 | Fontana et al. | 166/358 |
| 2006/0037782 | A1 | | 2/2006 | Martin-Marshall | |
| 2009/0095464 | A1 | | 4/2009 | McGrath et al. | |
| 2009/0260829 | A1 | | 10/2009 | Mathis | |
| 2010/0155073 | A1 | * | 6/2010 | Blank et al. | 166/338 |
| 2011/0303416 | A1 | * | 12/2011 | Herman, II | 166/350 |
| 2012/0125623 | A1 | * | 5/2012 | Cargol et al. | 166/344 |
| 2012/0318521 | A1 | * | 12/2012 | Franklin et al. | 166/363 |
| 2012/0324876 | A1 | * | 12/2012 | Fuselier et al. | 60/327 |
| 2013/0020086 | A1 | * | 1/2013 | Anderson et al. | 166/339 |
| 2013/0032351 | A1 | * | 2/2013 | Smith | 166/339 |

* cited by examiner

*Primary Examiner* — Matthew Buck
*Assistant Examiner* — Aaron Lembo
(74) *Attorney, Agent, or Firm* — Egbert Law Offices, PLLC

(57) ABSTRACT

A fluid diverting apparatus for use with a blowout preventer or a wellhead has a lower marine riser package having an interior passageway through which fluids can pass, an elongate member affixed to the lower marine riser package at an end opposite the blowout preventer stack or the wellhead, and a tubular member extending through a portion of the interior of the elongate member. The tubular member extends through a portion of the interior passageway of the lower marine riser passage. A seal is formed in one of the lower marine riser package of the elongate member so as to extend around an exterior of the tubular member so as to allow fluids to flow through a passage in the tubular member.

5 Claims, 2 Drawing Sheets

INSERT TUBE FOR USE WITH A LOWER MARINE RISER PACKAGE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to systems for diverting the flow of hydrocarbons from a damaged blowout preventer or a wellhead. More particularly, the present invention relates to diverter systems whereby the diverter is incorporated into the lower marine riser package so as to allow for the diversion of the flow of high pressure fluids to a location away from the damaged blowout preventer and/or wellhead.

2. Description of Related Art Including Information Disclosed Under 37 CFR 1.97 and 37 CFR 1.98

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

The well and the BOP connect the surface drilling vessel to a marine riser pipe, which carries formation fluids (e.g., oil, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impact.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disburse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

Whenever the high pressure hydrocarbons are released into the subsea environment. A waste of the hydrocarbons will occur. If a substantial amount of such hydrocarbons are released, then the production of such hydrocarbons is diminished. As a result, it is desirable to recapture such hydrocarbons and to avoid the release of such hydrocarbons into the subsea environments.

In past diversion systems, a variety of components are connected to a capping stack or a diverter system. These components involve the connection of various hoses to the subsea tree, to the subsea mandrel, or to other apparatus in the subsea environment. This is a very complicated and time-consuming procedure. Several ROVs would be required in order to complete such installations. The completion of such installations can be very difficult considering the nature of the blowout. The equipment often needs to be transported from remote locations in order to be effectively installed. As such, it would be desirable to be able to provide a system whereby the equipment necessary for the capping of the damaged blowout preventer is easily available or made available in the location of the blowout.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a marinized coiled string injector is moved by positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. Pat. No. 4,444,250, issued on Apr. 24, 1984 to Keithahn et al., teaches a flow diverter apparatus having a housing and a piston with an annular packer disposed therein. The diverter has passages in the piston and housing walls providing fluid communication between the borehole and a vent line. A valve in the vent line is opened before the packer of the apparatus is closed about a tubular member in the bore or completely closes the vertical flow path of the bore. This diverts pressurized borehole fluid away from the rig equipment and personnel.

U.S. Pat. No. 4,502,534, issued on Mar. 5, 1985 to Roche et al., describes a flow diverter for connection to a drilling conduit beneath a drilling rig floor for diverting pressurized well bore fluid in the conduit from the rig and sealing the annulus between a pipe or other object and the conduit or closing the vertical flow path of the conduit. The apparatus has a housing, and annular packing element and two pistons. The housing is provided with at least one outlet passage in the wall of its body. One of the two pistons acts as a sliding sleeve valve in cooperation with the housing wall for preventing fluid communication between the outlet passage and the interior of the housing when it is in a nonactuated or normal position and for allowing fluid communication when it is in an actuated or diverting position.

U.S. Pat. No. 4,646,844, issued on Mar. 3, 1987 to Roche et al., shows a diverter/BOP system and method for a bottom-supported offshore drilling rig. The system includes a fluid flow controller and at least two bases adapted for being alternatively removably secured to the controller. When the first base is in combination with the fluid flow controller, the system may be used only as a diverter and when the second base is used in combination with the fluid flow controller the system may be used only as a blowout preventer.

U.S. Pat. No. 5,323,860, issued on Jun. 28, 1994 to B. J. Watkins, describes an apparatus for connecting a diverter assembly to a blowout preventer stack. An upper tubular member is adapted to be connected to the diverter assembly to form a lower continuation of the lower end of its bore. A lower tubular member is adapted to be connected to the blowout preventer stack to form an upper continuation of the upper end of its bore. A tubular body extends between and is pivotally and sealably connected to the upper and lower tubular members to connect their bores.

U.S. Pat. No. 6,230,824, issued on May 15, 2001 to Peterman et al., teaches a rotating subsea diverter for isolating fluid in a well from other fluid above the well. The rotating diverter includes a housing body which has a bore running through it. A retrievable spindle assembly includes a spindle and a bearing assembly that is disposed in the bore. The bearing assembly supports the spindle for rotation. The spindle is adapted to receive and seal around a tubular member. The rotation of the tubular member rotates the spindle within the bore.

U.S. Pat. No. 7,308,954, issued on Dec. 18, 2007 to P. S. Martin-Marshall, shows a rotating diverter head for use on a blow out preventer stack of an oil well. The head provides for sealing and rotation of a drill pipe through the head and includes a flange on which the head is rotatable. The flange connects the head to the stack whereupon it can be rotated to align a return flow line before being locked in position.

U.S. Patent Publication No. 2006/0037782, published on Feb. 23, 2006 to P. S. Martin-Marshall, describes a monitoring system for a rotating diverter head for use in an oil well. The system includes a pressure sensor which is mounted beside the stripper rubber which contacts the drill pipe. An increase in the pressure monitored provides early warning of degradation or imminent failure of the seal.

It is an object of the present invention to provide a method and apparatus for containing the flow of fluids resulting from a damaged wellhead and/or blowout preventer.

Another object of the present invention to provide an apparatus that is attachable to a lower marine riser package and into the blowout preventer and/or wellhead so as to contain the flow of fluid in the event of a failure of the blowout preventer and/or wellhead.

It is another object of the present invention to provide a method and apparatus that can recover substantially all of the fluids flowing from the damaged blowout preventer and/or wellhead and for preventing the mixing of such fluids with seawater.

It is another object of the present invention to provide an apparatus and method that is of a cost low enough to allow for rebuilding the system and for keeping the system on the rig or at a shorebase for multiple rigs in an area.

It is still further object of the present invention to provide an apparatus and method that allows for a very quick response.

It is still the further object of the present invention to provide an apparatus and method for diverting the flow of fluids from a damaged blowout preventer and/or wellhead which can be installed while the well is flowing out.

Still another object of the present invention to provide an apparatus and method for diverting fluids from a damaged blowout preventer and/or wellhead that allows for the use of chokes and outlet valves to test for a compromised well integrity.

These and other objects and advantages of the present invention will become apparent from a reading of the attached specification and appended claims.

BRIEF SUMMARY OF THE INVENTION

The present invention is an apparatus for diverting the flow of fluids from a damaged wellhead or blowout preventer which comprises a blowout preventer stack, a lower marine riser package affixed to the blowout preventer stack and extending upwardly therefrom, an elongate member affixed to the lower marine riser package at an end opposite the blowout preventer stack, and a tubular member extending through a portion of the interior of the elongate member. The tubular member extends through a portion of the interior passageway of the lower marine riser package. The tubular member has an open end within the interior passageway of the lower marine riser package. At least one of the lower marine riser package or the elongate member has a seal extending around an exterior of the tubular member so as to allow the fluids to flow through a passage in the tubular member.

A first outlet is in communication with the passage of the tubular member. This first outlet extends outwardly of the elongate member. The first outlet has a valve cooperative therewith so as to control the fluids from the passage of the tubular member through the outlet. A second outlet is in communication with the passage of the tubular member. The second outlet extends outwardly of the elongate member. The first and second outlets extend radially outwardly of the elongate member in generally opposite directions.

The seal can be an annular member positioned in the lower marine riser package. The annular member is movable between an open position allowing the fluids to flow around an exterior of the tubular member and a closed position in liquid-tight relationship against an exterior of the tubular member. The tubular member defines an annulus within the interior passageway of the lower marine riser package. The lower marine riser package has a fluid line connected to and in selective communication with the annulus.

The elongate member has a plug extending across an interior thereof in a location above the tubular member. The elongate member is in flanged connection with the lower marine riser package. The lower marine riser package has a flex joint therein. The tubular member has a seal extending therearound in a location above the flex joint. The seal is in liquid-tight sealing relation with at least one of a wall surrounding the interior of the elongate member and a wall surrounding the interior passageway of the lower marine riser package. The elongate member has a connector therein thereof suitable for connection to a riser assembly.

Within the concept of the present invention, this apparatus can also be connected to a damaged wellhead. In this arrangement, the lower marine riser package is affixed to the damaged wellhead.

The present invention is also a process of diverting fluids from a damaged blowout preventer or wellhead. This process includes the steps of: (1) installing a tubular member within an interior of an elongate member such that the end of the tubular member extends outwardly of a first end of the elongate member; (2) affixing in a lower marine riser package to the first end of the elongate member such that the inlet of the tubular member is positioned within an interior passageway of the lower marine riser package; (3) connecting a riser to a second end of the elongate member; and (4) affixing the lower marine riser package to the blowout preventer or to the wellhead such that the interior passageway of the lower marine riser package is in communication with the fluid passageway of the blowout preventer of wellhead.

The exterior of the tubular member is sealed within the lower marine riser package so as to cause fluid in the interior passageway of the lower marine riser package to flow through a passage of the tubular member. The fluid from the interior passageway of the lower marine riser package is diverted outwardly through the outlet of the tubular member. A valve associated with the outlet of the tubular member is opened so as to allow the fluid to pass outwardly therethrough.

This foregoing section is intended to describe, with particularity, the preferred embodiments of the present invention. It is understood that modifications to these preferred embodiments can be made within the spirit of the present invention. As such, this section should not be construed, in any way, as limiting of the broad scope of the present invention. The present invention should be limited by the following claims and their legal equivalents.

DETAILED DESCRIPTION OF THE INVENTION

Figure 1:
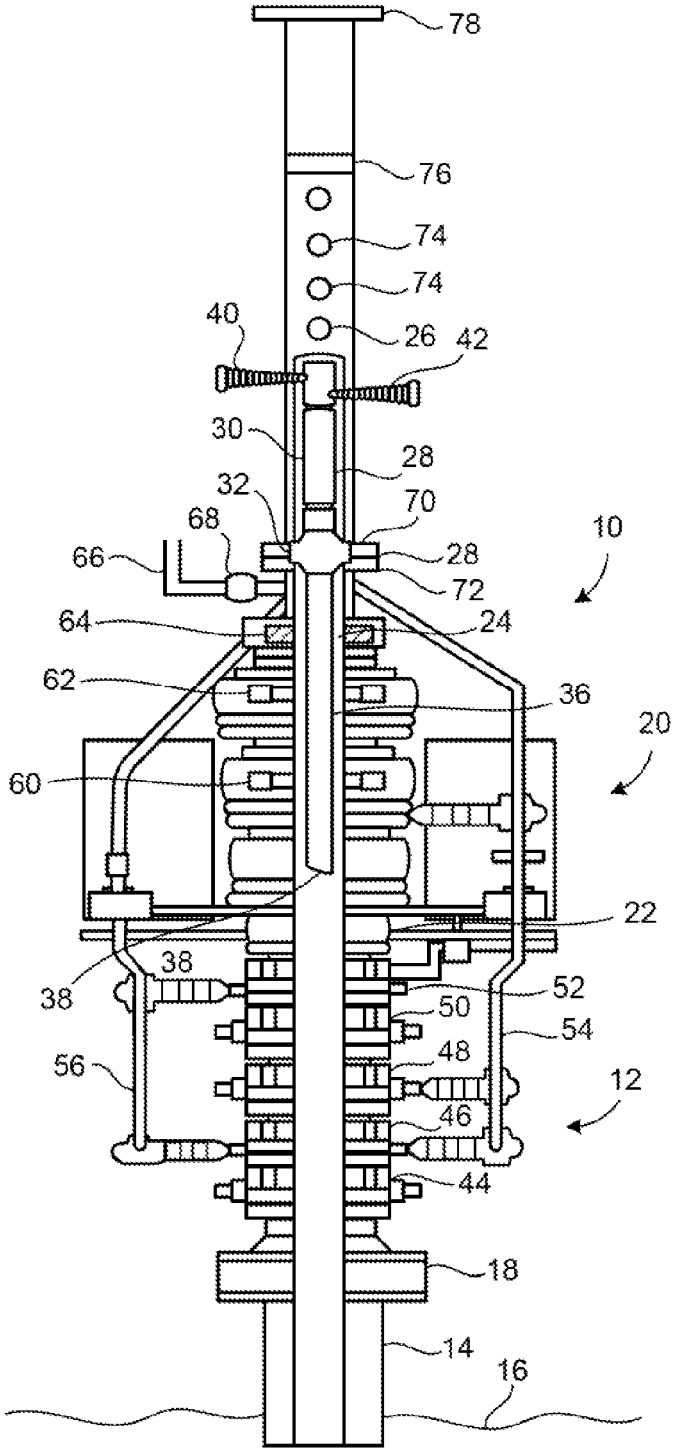
FIG. 1 is a cross-sectional view showing the apparatus for diverting fluids in accordance with the preferred embodiment of the present invention.

Referring to FIG. 1, there is shown the apparatus 10 for the diversion of fluids from a damaged blowout preventer and/or wellhead. The apparatus 10 includes a blowout preventer stack 12 that is secured to a wellhead 14. The wellhead 14 extends outwardly of the sea floor 16. The blowout preventer stack 12 is affixed to the wellhead 14 by way of the wellhead connector 18 in a conventional fashion. The lower marine riser package 20 will be affixed to an upper end of the blowout preventer stack 12 opposite the wellhead connector 18. In particular, the lower marine riser package 20 is affixed to a hub 22 of the blowout preventer stack 12. The lower marine riser package 12 includes an interior passageway 24 that extends therethrough. The interior passageway 24 is suitable for allowing the flow of fluids to pass therethrough. An elongate member 26 is affixed by flange 28 to the upper end of the lower marine riser package 20 opposite the blowout preventer stack 12. The elongate member 26 includes an interior 28. A tubular member 30 will extend through the interior 28 of the elongate member 26 and into the interior passageway 24 of the lower marine riser package 12. A suitable seal 32 is positioned around the exterior of the tubular member 30 so as to be in sealed relationship between the wall surrounding the interior 28 of the elongate member 26 and the wall surrounding the interior passageway 24 of the lower marine riser package 20. As such, any fluids flowing through the annulus 36 (defined between the exterior of the tubular member 30 and the wall surrounding the interior 24 of the lower marine riser package 20) will flow into the open end 38 of the tubular member 30. A first outlet 40 is in communication with the passage of the tubular member 30. A second outlet 42 is in communication with the passage of the tubular member 30. As such, any fluids that flow through the passage of the tubular member 30 can exit therefrom through the first outlet 40 and the second outlet 42.

The blowout preventer stack 12 is in the nature of the a conventional blowout preventer. In particular, the blowout preventer stack 12 can include a lower (test) variable bore ram 44, a middle variable bore ram 46 and an upper variable bore ram 48. A casing shear ram 50 will be positioned above the variable bore rams 44, 46 and 48. A blind shear ram 52 is positioned above the casing shear ram 50. Suitable hydraulic connections 54 and 56 are provided so as to selectively actuate the variable bore rams 44, 46 and 48 and the shear rams 50 and 52. Hub 22 will be positioned at the upper end of the blowout preventer stack 12.

The lower marine riser package 20 will be affixed to the hub 22 of the blowout preventer stack 12. The lower marine riser package 20 has a generally standard configuration. In particular, there is a lower annular stripping element 60 and an upper annular 62. A flex joint 64 will be positioned above the upper annular 62. Each of these lower annular stripping elements 60, the upper annular 62 and the flex joint 64 will be positioned around the exterior of the portion of the tubular member 30 that extends into the interior passageway 24 of the lower marine riser package 20. A choke-and-kill line 66 will be in communication with the annulus 36 within the interior passageway 24 of the lower marine riser package 20. A suitable valve 68 can be provided on the choke-and-kill line 66.

The tubular member 30 has an upper portion that is received within the passageway 28 of the elongate member 26. Another portion of the tubular member 30 will extend through the seal 32 and into the interior passageway 24 of the lower marine riser package 20. In particular, the elongate member 26 has a first end with a flange 70 thereon. Flange 70 is secured to the flange 72 at the upper end of the lower marine riser package 20. The seal 30 is illustrated as generally located at the interface of the flanges 70 and 72. However, within the concept of the present invention, the seal 32 can be positioned in other locations along the length of the tubular member 30. Importantly, the seal 32 will be positioned above the flex seal 64 of the lower marine riser package 20.

The first outlet 40 will extend through the wall of the elongate member 26. The first outlet 40 is in fluid communication with the passage of the tubular member 30. A suitable valve can be provided on or in association with the first outlet 40 so as to allow a remotely-operated vehicle (ROV) to open and close the outlet 40. Similarly, the second outlet 42 will extend through the wall of the elongate member 26. The second outlet 40 will also be in communication with the passage of the tubular member 30. The second outlet 42 extends radially outwardly of the tubular member 30 in a direction opposite to that of the first outlet 40. The second outlet 42 can also have a valve thereon or in association therewith so that an ROV can control the opening and closing of the second outlet 42.

The elongate member 26 is illustrated as having a plurality of holes 74 opening to the interior 28. As such, should any fluids flow through the annulus 36 and past the seal 32, they would be vented to the subsea environment. This would serve to prevent any over-pressure conditions from adversely affecting the integrity of the apparatus 10 of the present invention. A plug 76 can be located within the interior 28 of the elongate member 26. A flange 78 is located at the second, or upper, end of the elongate member 26. Flange 78 could be suitably connected to a riser extending to a surface location.

Figure 2:
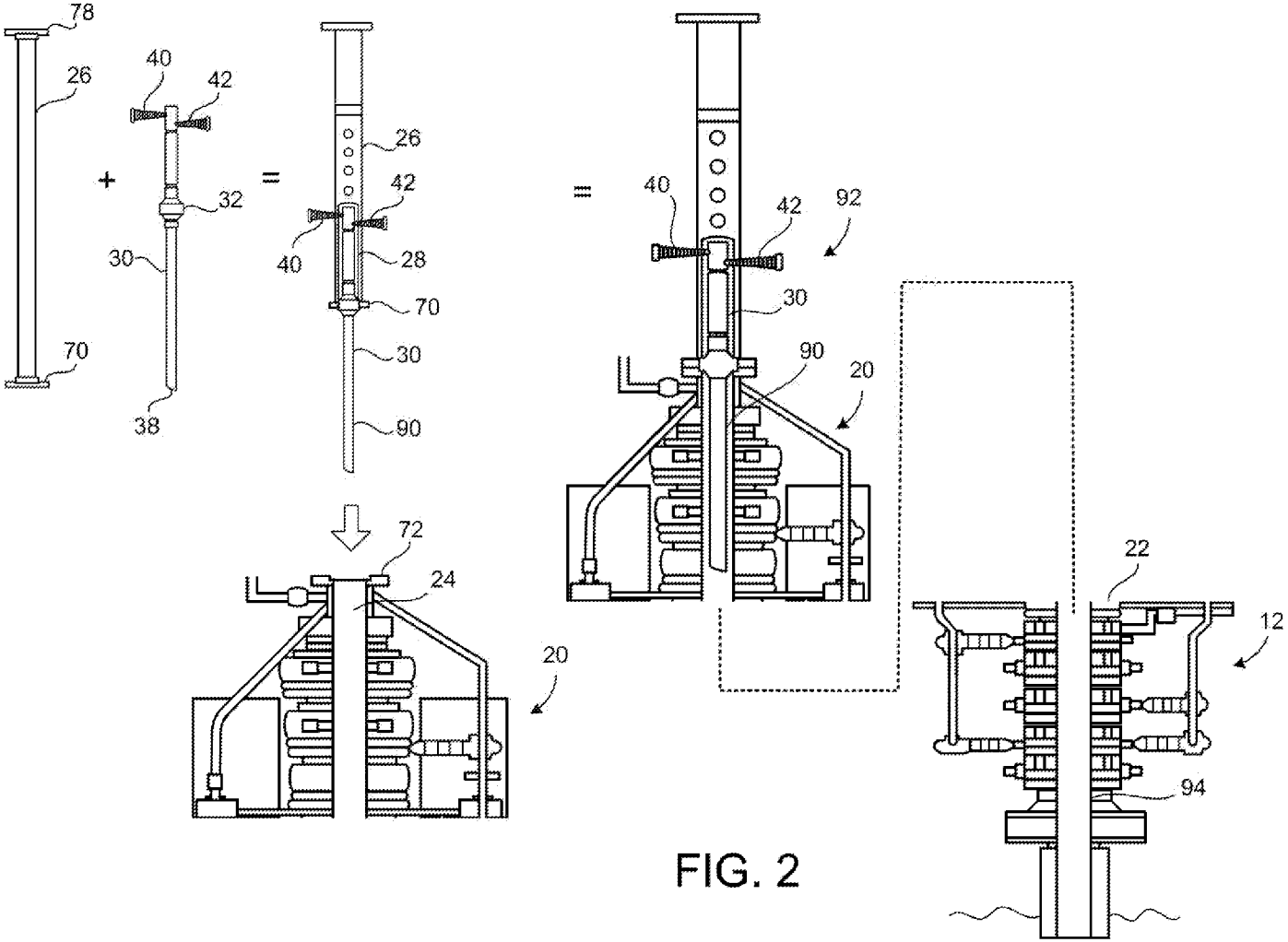
FIG. 2 is an exploded view of the apparatus of the present invention for diverting fluids.

FIG. 2 illustrates the assembly of the apparatus of the present invention. In particular, in FIG. 2, it can be seen that the elongate member 26 has a flange 70 at a first end thereof and a flange 78 at an opposite end thereof. The tubular member 30 is illustrated as having the seal 32 affixed over the exterior surface thereof. The tubular member 30 has an open end 38 at a location opposite the first outlet 40 and the second outlet 42.

The tubular member 30 is installed within the interior 28 of the elongate member 26. As a result, the first outlet 40 will extend outwardly through a wall of the elongate member 26 and the second outlet 42 will extend outwardly through the wall of the elongate member 26. A portion 90 of the tubular member 30 is extended so as to be positioned within the interior passageway 24 of the lower marine riser package 20. In this configuration, the flange 70 of the elongate member 26 can be bolted to the flange 72 associated with the lower marine riser package 20. FIG. 2 illustrates the assembled arrangement in which the tubular member 30 has its portion 90 located within the interior passageway 24 of the lower marine riser package 20.

When a damage to the blowout preventer stack 12 occurs, the assembly of the lower marine riser package 20, the tubular member 30 and the elongate member 26 can be positioned, by way of the riser, onto the hub 22 of the blowout preventer stack 12.

During the installation of the assembly 92 onto the blowout preventer stack 12, the first outlet 40 and the second outlet 42 will be in an open configuration. As such, fluids passing through the bore 94 of the blowout preventer stack 12 can flow freely through the interior passageway 24 of the lower marine riser package 20 and upwardly through the passage of the tubular member 30 so as to escape through the first outlet 40 and the second outlet 42. As such, the flow of fluids outwardly of the blowout preventer stack 12 will flow freely. This allows the assembly 92 to be installed upon the hub 22 of the blowout preventer stack 12. Since the outlets 40 and 42 are open, there will be no resistance to the flow of the fluids.

It is important during the assembly that the annulars 60 and 62 of the lower marine riser package 20 are open. The lower marine riser package 20 will be assembled onto the blowout preventer stack 12, connected, and then tested. At least the annular 62 of the lower marine riser package 20 can be closed upon the exterior surface of the tubular member 30. This will force the flow directly outwardly of the outlets 40 and 42 of the tubular member 30. The well flow through the outlets 40 and 42 can be reduced through the use of ROV choke actuation. The blinds 50 and 52 of the blowout preventer stack 12 could also be closed in order to reduce flow. If the well integrity should allow, the outlets 40 and 42 can be closed completely. The operation can continue with reduced flow and with dispersant until additional response capability arrives. Ultimately, if the pressures of the fluid are greater than that which can be withstood by the annulars 60 and 62 and the seal 32, any such over-pressure fluids can be released to the environment through the hole 74 formed on the elongate member 26.

The present invention provides capping stack functionality through the use of the lower marine riser package and the assembly of the elongate member 26 with that of the tubular member 30. The cost is low enough so as to allow for the pre-building of the assembly 92. This assembly could be kept on the rig or at a shore base for use by multiple rigs within an area. The easy availability of the present invention will allow for a very quick response time. The pressure rating is limited to that of the annulars 60 and 62 of the lower marine riser package 20. The assembly 92 can easily be installed while the well is flowing out. Chokes and outlet valves can be utilized so as to test for compromised well integrity. Pressure and temperature sensors can also be added to the apparatus 10 of the present invention. Additionally, chemical injection can also be provided on the apparatus 10 of the present invention. Although the use of the apparatus 10 of the present invention is illustrated in association with a blowout preventer stack 12, it is possible that the present invention can also be used in association with a damaged wellhead 14. As long as the integrity of the wellhead connector 18 remains, the assembly 92 could be applied directly to the wellhead 14 for use in diverting fluids therefrom and for the reduction of releases from the wellhead.

The foregoing disclosure and description of the invention is illustrative and explanatory thereof. Various changes in the details of the illustrated construction or in the steps in the described method, can be made within the scope of the present invention without departing from the true spirit of the invention. The present invention should only be limited by the following claims and their legal equivalents.

I claim:

1. A wellhead assembly comprising:

a blowout preventer stack;

a lower marine riser package having an interior passageway through which fluids can pass, said lower marine riser package affixed to said blowout preventer stack and extending upwardly therefrom;

an elongate member having an interior, said elongate member affixed to said lower marine riser package at an end opposite said blowout preventer stack; and a tubular member extending through a portion of said interior of said elongate member, said tubular member extending through a portion of said interior passageway of said lower marine riser package, said tubular member having an open end within said interior passageway of said lower marine riser package, said tubular member defining an annulus within said interior passageway of said lower marine rise package, said lower marine riser package having a fluid line connected to and in selective communication with said annulus, said elongate member having a plug extending along said interior thereof at a location above said tubular member so as to as to block a flow of fluid through said elongate member.

2. The wellhead assembly of claim 1, said elongate member being in flanged connection with said lower marine riser package, said lower marine riser package having a flex joint therein, said tubular member having a seal extending therearound in a location above said flex joint, said seal being in liquid-tight sealing relation with at least one of a wall surrounding said exterior of said elongate member and a wall surround said interior passageway of said lower marine riser package.

3. The wellhead assembly of claim 1, said elongate member having a connector at an upper end thereof suitable for connection to a riser assembly.

4. A process of diverting fluids from a damaged blowout preventer or wellhead, the process comprising;

installing a tubular member within an interior of a elongate member so as to define an annulus between an exterior of said tubular member and an interior of said elongate member, said tubular member having an inlet formed at an end of said tubular member that extends outwardly of a first end of said elongate member, said tubular member having an outlet extending outwardly of said elongate member;

plugging said tubular member at a location above said tubular member;

affixing a lower marine riser package to a first end of said elongate member such that said inlet of said tubular member is positioned within an interior passageway of said lower marine riser package;

connecting a riser to a second end of said elongate member;

affixing said lower marine riser package to said blowout preventer or to said wellhead such that said interior passageway of said lower marine riser package is in communication with a fluid passageway of the blowout preventer or the wellhead;

sealing around an exterior of said tubular member within said lower marine riser package so as to cause fluid in said interior passageway of said lower marine riser package to flow through a passage of said tubular member;

diverting the fluid from said interior passageway of said lower marine riser package outwardly through said outlet of said tubular member; and venting fluids entering said annulus outwardly of said elongate member.

5. The process of claim 4, further comprising:

opening a valve associate with said outlet of said tubular member so as to allow the fluid to pass outwardly therethrough.

* * * * *